US006129494A

United States Patent [19]

Kutschan et al.

[11] Patent Number: 6,129,494

[45] Date of Patent: Oct. 10, 2000

[54] COMPOUND DIP PROCESS FOR METAL CANS

[75] Inventors: Reinhard Kutschan, Salzqitter; Hellmut Bünsch, Hamburg, both of Germany

[73] Assignee: Schmalbach-Lubeca AG, Braunschweig, Germany

[21] Appl. No.: 08/849,948

[22] PCT Filed: Dec. 22, 1995

[86] PCT No.: PCT/DE95/01855

§ 371 Date: Aug. 20, 1997

§ 102(e) Date: Aug. 20, 1997

[87] PCT Pub. No.: WO96/20051

PCT Pub. Date: Jul. 4, 1996

[30] Foreign Application Priority Data

Dec. 23, 1994 [DE] Germany ..... 44 46 393

[51] Int. Cl.[7] ..... B21D 51/26

[52] U.S. Cl. ..... 413/1; 413/2; 413/4; 413/7; 413/27; 413/34

[58] Field of Search ..... 413/1, 2, 4–7, 413/26, 27, 34

[56] References Cited

U.S. PATENT DOCUMENTS

| | | | |
|---|---|---|---|
| 3,310,196 | 3/1967 | Flaherty | 220/67 |
| 3,322,045 | 5/1967 | Tanona | 93/39.1 |
| 3,462,331 | 8/1969 | Simons | 156/231 |
| 3,505,932 | 4/1970 | Fogg | 93/39.1 |
| 3,822,763 | 7/1974 | Ellerbrock et al. | 413/7 |
| 3,952,677 | 4/1976 | Hartman et al. | 413/7 |
| 4,037,550 | 7/1977 | Zofko | 413/20 |
| 4,089,283 | 5/1978 | Mertens et al. | 113/120 |
| 4,138,384 | 2/1979 | Neumann | 260/29.7 |
| 4,201,308 | 5/1980 | Neumann | 220/81 |
| 4,626,157 | 12/1986 | Franek et al. | 413/1 |

FOREIGN PATENT DOCUMENTS

| | | |
|---|---|---|
| 3104715 | 8/1982 | Germany . |
| 3336941 | 4/1985 | Germany . |
| 4329948 | 3/1995 | Germany . |

OTHER PUBLICATIONS

Rompp Chemie Lexikon, Georg Thieme Verlag Stuttgart—New York.

Fertigungstechnik und Arbeitsmaschinen, Rowohlt.

*Primary Examiner*—Eugene L. Kim

*Attorney, Agent, or Firm*—Duane, Morris & Heckscher LLP

[57] ABSTRACT

Sealant is applied onto or into a folded-seam closure of a metal can. Instead of introducing sealant into the U-shaped lid flange and drying, according to the invention the compound or sealant is applied to the base flange, the base of the metal can being dipped into a current of fluid sealant or at least brought into contact with it at the surface. This substantially improves the precision of dosing and the exact amount of applied sealant.

31 Claims, 2 Drawing Sheets

COMPOUND DIP PROCESS FOR METAL CANS

The technical field of the invention is a process for an application of sealant (so-called "compound") to a body hook of a body of a metal can.

Prior art realizes sealings on metal packings such that a sealant, which is usually provided on the basis of a rubber preparation or a synthetic caoutchouc, is dispersed in water or organic solvents (SBC or WBC) and introduced into the end hook of a can end or into the fold edge of a can base with a spraying gun. Subsequently, the water or the solvent (mixture) has to be evaporated and the dried seal has to be stored at least 24 hours before closing the can end and the can body. In the prior art process, the quantity of sealant used is subject to a statistical variation, the effectively introduced or applied sealant depending to a considerable degree on the viscosity, which in turn depends on the temperature. Consequently, the temperature determines the quantity of sealant introduced, namely the circumferential distribution of sealant as well as the thickness of the sealant introduced.

It is an object of the present invention to improve the processes for introduction or application of sealant previously used, particularly with regard to their precision and reproducibility. The objective is to make the quantity of sealant applied or introduced independent on external influences to such a degree that it may be positioned more precisely to permit on a long-term basis the saving of considerable quantities of sealant.

Said object is achieved by applying a sealant to the body hook of a can body, and not to a can end, said application being effected before flanging the seam, which particularly is a double seam.

By realizing the inventive idea, a frequent control of the sealant is not required, the can body itself being dipped from above into the sealant or contacting it to such a degree that only the required portion of the body hook is wetted with said sealant. Compared to prior art, the inventive process permits a better positioning and therefore, a more precise application and consequently a more economizing dosing of the sealant. Thus a considerable quantity of sealant is saved over a fairly long time. Due to the invention, defects in the rubber-coating of can ends are a thing of the past.

To fluidize the raw sealant, it is softened (fluidized), usually by an extruder or compounder. The compound may then be transferred on a gravure roller which may be supplied by a sheet die, however, said sheet die itself also being able to provide the fluidal compound without using a deep-draw roller[1], said compound presenting a certain minimum dipping depth; said minimum depth may be controlled.

[1] German term "Tiefziehwalze" (=deep-draw roller) must obviously read correctly "Tiefdruckwalze" (=gravure roller).

Also, time, speed and dipping depth of the dipping movement of the body hook may be controlled.

The application of compound on the seam portion of the can body (body hook) is improved with regard to uniformity by rotating said can body in the indicated direction α, (alpha) around its own axis at least when it contacts or is dipped into the sealant. For this purpose, a magnetic drive (for soft metal[2] cans) may be provided.

[2] German term "Weichblechdosen" (=soft metal cans) is an obvious typing error. The correct term is "Weiβblechdosen" (=tin plate cans).

By combining a dipping movement in vertically downward direction and a rotatory movement around the axis, a high degree of uniformity of sealant on the body hook is achieved, simultaneously permitting a precise positioning and dosing and thus savings of largest possible quantities of sealant to achieve smallest necessary quantities of sealant on the body hook.

In the following, the invention is described more in detail on the basis of embodiments.

If a can is in closed condition, an end hook 2*a*,2*b* is seamed together with a body hook 1*a* to provide an air-tight double seam D. A sealant C is provided on the upper portion of the seam portion, between the seam portion 1*a* of the can body and the outer seam portion 2*b* of the can end portion 2*a*,2*b*, and, possibly, a further sealant F is provided on the lower portion of said seam.

Figure 2:
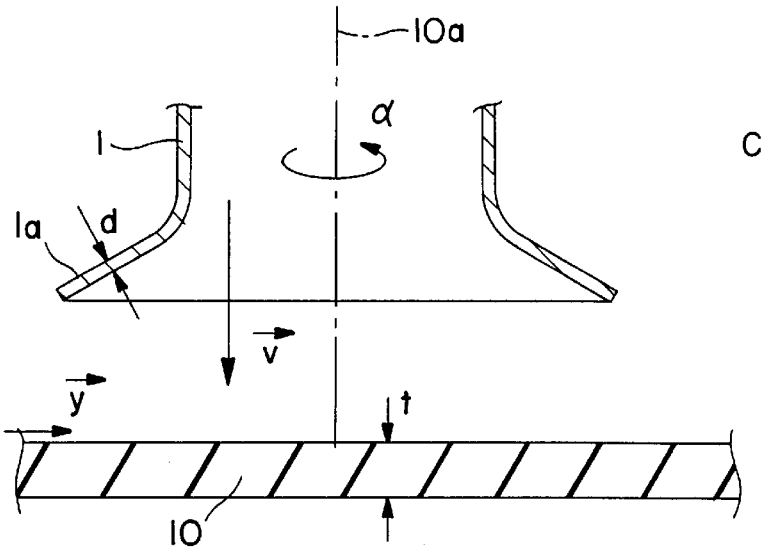
FIG. 2 shows the dipping movement in downward direction of a schematically illustrated can body 1 into a fluidal sealant 10 being continuously replenished in y direction ("stream of sealant").
Figure 3:
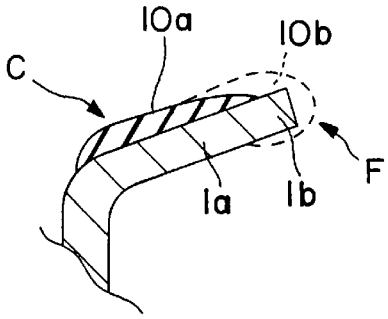
FIG. 3 is an enlarged view of the edge portion of a seam portion 1*a* of a can body, onto which a defined, precisely dosed quantity 10*a* of a sealant has been applied according to the process of FIG. 2.

FIGS. 2 and 3 illustrate the application of at least one of said sealants C and F.

FIG. 2 illustrates the principle, according to which a can body 1, being shown schematically, is dipped into a fluidal sealant 10 ("raw sealant"). Said can body 1 is moved downward v in direction of the can axis 100 until the body hook 1*a* contacts said fluidal compound 10. Said movement v may as well be continued a bit further downward, so that the lower (reverse) surface of said body hook 1*a* is also dipped.

The dipping depth may exceed the thickness d of the metal sheet so that said compound 10 also reaches the reverse side (upper side) of said body hook 1*a*, thus providing a sealing portion F when the can is closed.

Figure 4:
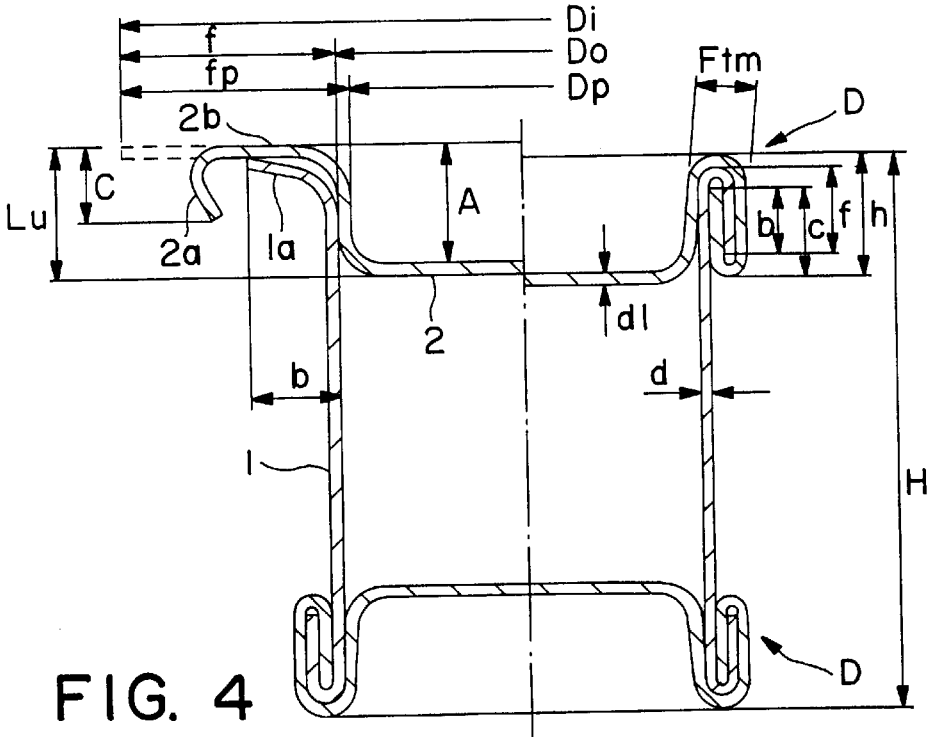
FIG. 4 and FIG. 5 show embodiments of usual seam geometries on metal cans.
Figure 5:
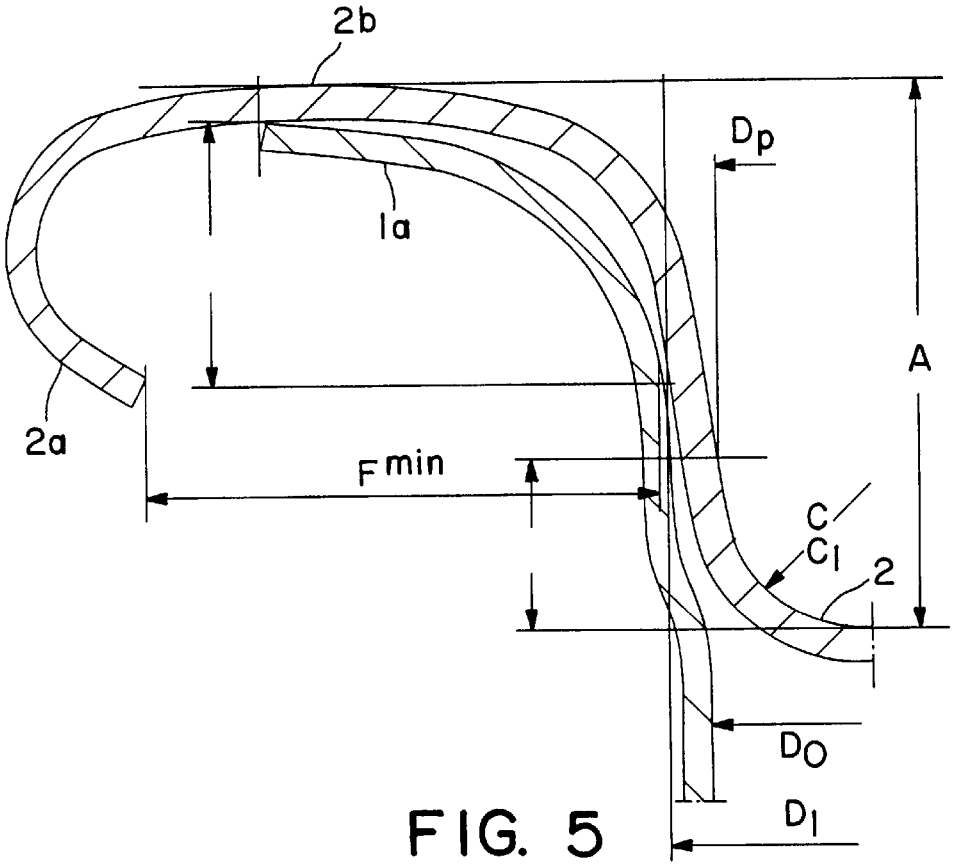

FIG. 2 is an exaggerated illustration showing a (frustoconical) inclination of said body hook 1*a*, said inclination being substantially horizontal with an only slight inclination, such as shown in FIGS. 4 and 5.

In FIG. 2, the downward movement is designated by a velocity v which is changed depending on the position of said can body 1 and the interspace between said can body 1 and said compound 10. The smaller the interspace between said body 1 and said fluid 10, the lower the velocity of said downward movement.

During said downward movement or immediately when contacting or being dipped into said fluidal compound 10, said body 1 may rotate around the can axis 100, thus improving the uniformity of application of said compound.

A movement y of said fluid 10 is schematically illustrated, representing a slight movement of said fluid or at least a continuous replacement of fluid in a quantity corresponding to the quantity of sealant being applied to said body hooks 1*a* which are dipped into or brought in contact with said sealant. Said fluidal compound 10 may be produced by an extruder, its temperature may be controlled to maintain its viscosity on a substantially constant level.

FIG. 3 illustrates a sealant 10*a* being positioned on said body hook 1*a* in an exactly dosed quantity. Said Figure only shows an edge portion 1*a* of said can body 1 being illustrated in upright position with its base downwards. If, after dipping and removing said body, said compound 10 still presents a certain mobility or viscosity, said compound 10*a* is still able to slightly move in radially inward direction on the can end seam 1*a* after quickly reversing said can 1.

Said movement in radially inward and downward direction depends on the ambient temperature and the inclination of said body hook 1*a* with regard to the horizontal plane.

Figure 1:
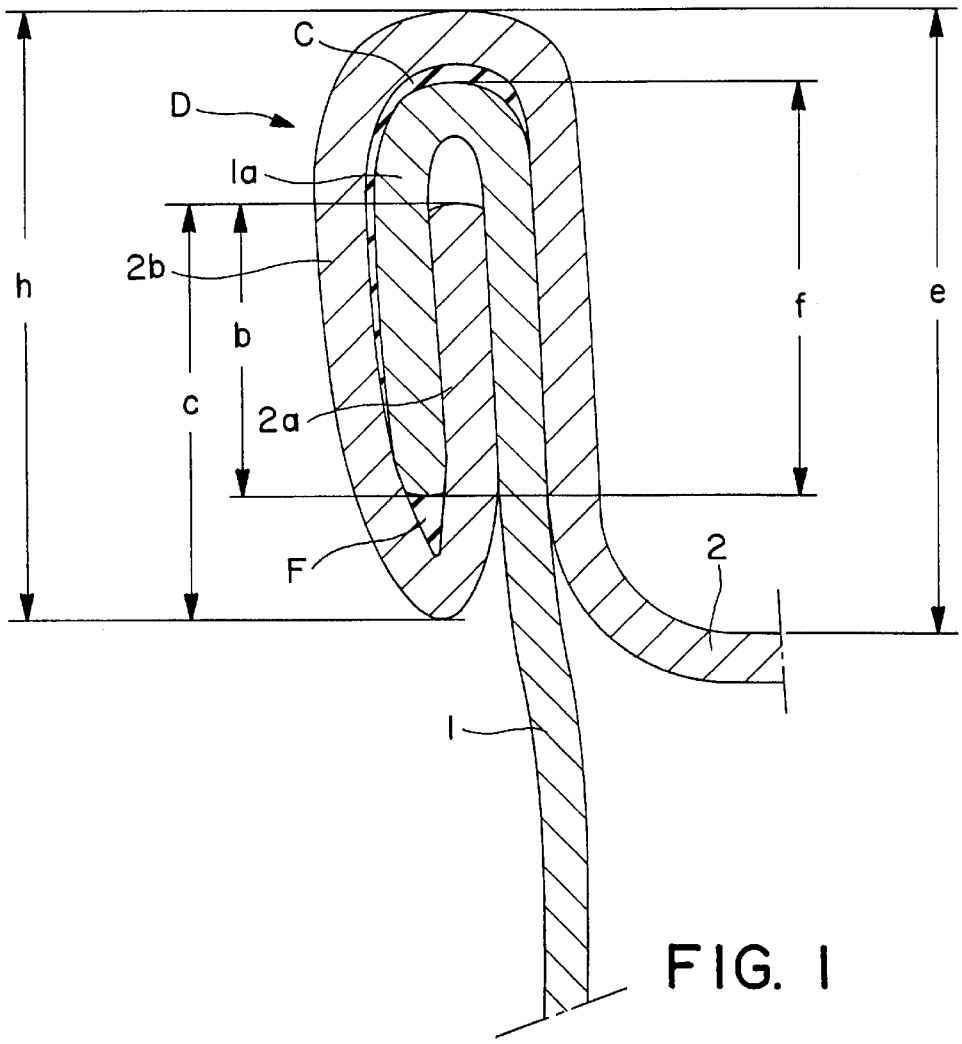
FIG. 1 illustrates a closed double seam being provided on the upper edge of a metal packing. D designates the double seam, reference numeral 1 designates the body of the metal can and reference numeral 2 designates the can end.

If the body hook 1*a* is dipped somewhat more deeply into said fluid 10, a bilateral coating 10*b* with compound is provided around the outer edge 1*b* of said body hook 1*a*, thus forming a lower sealing portion F when seaming. Said compound portions C and F according to FIG. 1 are indicated in FIG. 3.

Said process of application may equally be used in the can end and base seam of three-piece cans (see FIG. 4). Its use is also possible with stretched one-piece can bodies, their upper portion drawn-in or not (see FIG. 5).

FIG. 4 and FIG. 5 comprise usual seam dimension and their usual reference numerals.

We claim:

1. A process for the application of a compound between a metal end hook and a metal body hook of a seam between a metal end and a metal body of a metal packing, whereby said compound is applied to said body hook before applying said metal end to said body hook and closing said end hook and said body hook, wherein said compound is applied to said body hook by dipping the body hook from above into said compound.

2. The process according to claim 1, wherein at least one of a radial position and a distribution of the applied compound is modified by quickly reversing said metal body after dipping into said compound, and wherein said modification is directed particularly slightly radially inward.

3. The process according to claim 1, wherein at least one of a dipping depth of said body hook into said compound and a minimum depth of said compound is controlled.

4. The process according to claim 1, wherein said compound is provided via a sheet die for application on said body hook.

5. The process according to claim 1, wherein said metal body and said body hook are rotated at least when being dipped into said compound.

6. The process according to claim 1, wherein the application of said compound is effected by a downward movement and a rotatory movement of said metal body.

7. The process according to claim 1, wherein the dipping depth of said body hook is slightly deeper than the thickness of the metal body to apply said compound also on a reverse side of said body hook.

8. The process according to claim 7, wherein said compound is applied onto and around an outer edge of said body hook by dipping.

9. The process according to claim 1, wherein said seam is a multiple seam.

10. The process according to claim 1, wherein said seam is a double seam.

11. A process for the application of a compound between an end hook and a body hook of a seam between a metal end and a metal body of a metal packing, whereby said compound is applied before applying said metal end and closing said end hook and said body hook, characterized in that said compound is applied to said body hook by bringing said body hook into contact with said compound wherein at least one of a radial position and a distribution of the applied compound is modified by quickly reversing said metal body after contacting said compound, and wherein said modification is directed particularly slightly radially inward.

12. The process according to claim 11, wherein said compound is provided via a sheet die for application on said body hook.

13. The process according to claim 11, wherein said metal body and said body hook are rotated at least when contacting said compound.

14. The process according to claim 11, wherein the application of said compound is effected by a downward movement and a rotatory movement of said metal body.

15. The process according to claim 11, wherein said seam is a multiple seam.

16. The process according to claim 11, wherein said seam is a double seam.

17. The process according to claim 11, wherein said compound is applied onto and around an outer edge of said body hook.

18. A process for the application of a compound between an end hook and a body hook of a seam between a metal end and a metal body of a metal packing, whereby said compound is applied before applying said metal end and closing said end hook and said body hook, characterized in that said compound is applied to said body hook by bringing said body hook into contact with said compound wherein said metal body and said body hook are rotated at least when contacting said compound.

19. The process according to claim 18, wherein at least one of a radial position and a distribution of the applied compound is modified by quickly reversing said metal body after contacting said compound, and wherein said modification is directed particularly slightly radially inward.

20. The process according to claim 18, wherein said compound is provided via a sheet die for application on said body hook.

21. The process according to claim 18, wherein the application of said compound is effected by a downward movement and a rotatory movement of said metal body.

22. The process according to claim 18, wherein said seam is a multiple seam.

23. The process according to claim 18, wherein said seam is a double seam.

24. The process according to claim 18, wherein said compound is applied onto and around an outer edge of said body hook.

25. A process for the application of a compound between an end hook and a body hook of a seam between a metal end and a metal body of a metal packing, whereby said compound is applied before applying said metal end and closing said end hook and said body hook, characterized in that said compound is applied to said body hook by bringing said body hook into contact with said compound wherein the metal body is displaced and rotated at least when contacting said compound.

26. The process according to claim 25, wherein at least one of a radial position and a distribution of the applied compound is modified by quickly reversing said metal body after contacting said compound, and wherein said modification is directed particularly slightly radially inward.

27. The process according to claim 25, wherein said compound is provided via a sheet die for application on said body hook.

28. The process according to claim 25, wherein said met al body and said body hook are rotated at least when contacting said compound.

29. The process according to claim 25, wherein said seam is a multiple seam.

30. The process according to claim 25, wherein said seam is a double seam.

31. The process according to claim 25, wherein said compound is applied onto and around an outer edge of said body hook.

* * * * *